US008587219B2

(12) United States Patent
Mohan et al.

(10) Patent No.: US 8,587,219 B2
(45) Date of Patent: Nov. 19, 2013

(54) LIGHTING CONTROL WITH AUTOMATIC AND BYPASS MODES

(75) Inventors: Tanuj Mohan, Mountain View, CA (US); Premal Ashar, Mountain View, CA (US); Loharasp M. Nasarbadi, Mountain View, CA (US); David Perkins, Mountain View, CA (US)

(73) Assignee: enLighted, Inc., Sunnyvale, CA (US)

( * ) Notice: Subject to any disclaimer, the term of this patent is extended or adjusted under 35 U.S.C. 154(b) by 363 days.

(21) Appl. No.: 13/043,745

(22) Filed: Mar. 9, 2011

(65) Prior Publication Data

US 2012/0229049 A1 Sep. 13, 2012

(51) Int. Cl.
*H05B 37/02* (2006.01)

(52) U.S. Cl.
USPC ..... 315/307; 315/312; 315/360; 315/362

(58) Field of Classification Search
USPC ..... 315/291, 294, 297, 307, 312, 360, 362
See application file for complete search history.

(56) References Cited

U.S. PATENT DOCUMENTS

| | | | | |
|---|---|---|---|---|
| 4,797,568 | A * | 1/1989 | Gumbs | 307/141 |
| 5,101,141 | A | 3/1992 | Warner et al. | |
| 5,179,324 | A | 1/1993 | Audbert | |
| 5,191,265 | A | 3/1993 | D'Aleo et al. | |
| 5,283,516 | A | 2/1994 | Lohoff | |
| 5,812,422 | A | 9/1998 | Lyons | |
| 6,057,654 | A | 5/2000 | Cousy et al. | |
| 6,188,181 | B1 | 2/2001 | Sinha et al. | |
| 6,342,994 | B1 | 1/2002 | Cousy et al. | |
| 6,548,967 | B1 | 4/2003 | Dowling et al. | |
| 7,309,985 | B2 | 12/2007 | Eggers et al. | |
| 7,348,736 | B2 | 3/2008 | Piepgras et al. | |
| 7,382,271 | B2 | 6/2008 | McFarland | |
| 7,437,596 | B2 | 10/2008 | McFarland | |
| 7,550,931 | B2 | 6/2009 | Lys et al. | |
| 7,566,137 | B2 | 7/2009 | Veskovic | |
| 7,792,956 | B2 | 9/2010 | Choong et al. | |
| 7,925,384 | B2 | 4/2011 | Huizenga et al. | |
| 8,476,844 | B2 * | 7/2013 | Hancock et al. | 315/307 |
| 2004/0002792 | A1 | 1/2004 | Hoffknecht | |
| 2005/0169643 | A1 | 8/2005 | Franklin et al. | |
| 2005/0231112 | A1 | 10/2005 | Woo et al. | |
| 2006/0275040 | A1 | 12/2006 | Franklin | |
| 2007/0057807 | A1 | 3/2007 | Walters et al. | |
| 2007/0061050 | A1 | 3/2007 | Hoffknecht | |
| 2007/0086128 | A1 | 4/2007 | Lane et al. | |
| 2007/0215794 | A1 | 9/2007 | Cernasov et al. | |

(Continued)

*Primary Examiner* — Tung X Le
(74) *Attorney, Agent, or Firm* — Brian R Short

(57) ABSTRACT

Methods, systems and apparatuses for controlling a light through an automatic mode and a bypass mode are disclosed. One method includes receiving physical signaling. Detection of a predetermined sequence of the physical signaling is used to determine whether to control the light in the automatic mode or the bypass mode. The automatic mode provides network control of the light, and the bypass mode bypasses the network control of the light. One lighting system includes a light, a sensor for receiving and sensing the physical signaling, and a controller detecting a predetermined sequence of the physical signaling. Detection of a predetermined sequence of the physical signaling is used to determine whether to control the light in the automatic mode or the bypass mode. The automatic mode provides network control of the light, and the bypass mode bypasses the network control of the light.

18 Claims, 6 Drawing Sheets

(56) References Cited

U.S. PATENT DOCUMENTS

| | | | | |
|---|---|---|---|---|
| 2008/0185977 | A1 | 8/2008 | Veskovic et al. | |
| 2008/0244104 | A1 | 10/2008 | Clemente | |
| 2009/0026966 | A1 | 1/2009 | Budde et al. | |
| 2009/0179596 | A1 | 7/2009 | Willaert et al. | |
| 2009/0195161 | A1 | 8/2009 | Lane et al. | |
| 2009/0261732 | A1* | 10/2009 | Bouchard | 315/82 |
| 2010/0034386 | A1 | 2/2010 | Choong et al. | |
| 2010/0135186 | A1 | 6/2010 | Choong et al. | |
| 2010/0264846 | A1 | 10/2010 | Chemal et al. | |
| 2010/0270933 | A1 | 10/2010 | Chemal et al. | |
| 2010/0295482 | A1 | 11/2010 | Chemal et al. | |
| 2010/0301777 | A1 | 12/2010 | Kraemer | |
| 2011/0031897 | A1 | 2/2011 | Henig et al. | |
| 2011/0144821 | A1* | 6/2011 | Nerone et al. | 700/296 |

* cited by examiner

LIGHTING CONTROL WITH AUTOMATIC AND BYPASS MODES

FIELD OF THE EMBODIMENTS

The described embodiments relate generally to lighting. More particularly, the described embodiments relate to methods, apparatuses and systems for lighting control through an automatic mode and a bypass mode.

BACKGROUND

Lighting control can be used to automatically control lighting under certain conditions, thereby conserving power. However, lighting control, specifically advanced lighting controls have not been widely adopted in the general commercial market because the installation, setup related costs and complexity have made these lighting systems prohibitively expensive for most commercial customers. Additionally, if these systems include intelligence, they are generally centrally controlled. Central control typically interprets Boolean (for e.g. contact closure) inputs from sensors and reacts according to pre-configured settings.

However, the people who are presently implementing intelligent lighting control systems are typically building facility managers who are generally a conservative group of people with a very skeptical view of new technology. Therefore, these people tend to be a part of the late majority in adopting new products.

It is desirable to have light systems that are robust and fault-tolerant. However, even robust, fault-tolerant systems can suffer from software bugs and be susceptible to cyber-attacks.

It is desirable to have a lighting method, apparatus and system for intelligent control of lighting that offers a fail-safe mode in case of failure of the intelligent lighting control.

SUMMARY

One embodiment includes a method of controlling a light through an automatic mode and a bypass mode. The method includes receiving physical signaling. Detection of a predetermined sequence of the physical signaling is used to determine whether to control the light in the automatic mode or the bypass mode. The automatic mode provides network control of the light, and the bypass mode bypasses the network control of the light.

Another embodiment includes a lighting system. The lighting system includes a light, a sensor for receiving and sensing the physical signaling, and a controller detecting a predetermined sequence of the physical signaling. Detection of a predetermined sequence of the physical signaling is used to determine whether to control the light in the automatic mode or the bypass mode. The automatic mode provides network control of the light, and the bypass mode bypasses the network control of the light.

Other aspects and advantages of the described embodiments will become apparent from the following detailed description, taken in conjunction with the accompanying drawings, illustrating by way of example the principles of the described embodiments.

DETAILED DESCRIPTION

The described embodiments are embodied in methods, apparatuses and systems for controlling operating modes of a light. A first mode is an automatic mode and a second mode is a bypass mode. Generally, the automatic mode includes a network controlling the light and the bypass mode includes bypassing the network control. Sequences of the physical signaling are used to allow an operator to set the lighting control in either the automatic mode or the bypass mode. The physical signaling can be sensed and the sequences detected by a controller.

Figure 1:
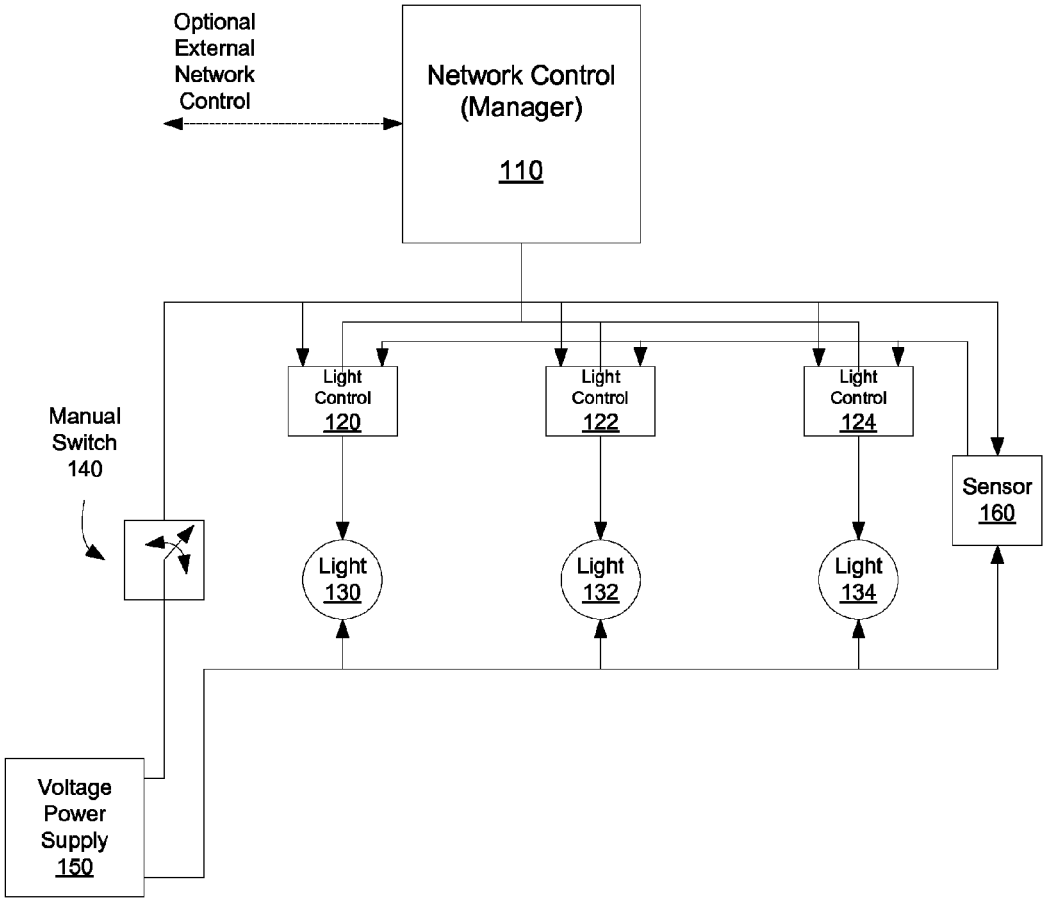
FIG. 1 shows a block diagram of an embodiment of a lighting system for providing control of lights through an automatic mode or a bypass mode.

FIG. 1 shows a block diagram of an embodiment of a lighting system for providing control of lights through an automatic mode or a bypass mode. As shown, the lighting system includes multiple lights 130, 132, 134 which are controlled by light controllers 120, 122, 124. When in the automatic mode, the lights 130, 132, 134 are individually or as a group controlled by, for example, a network manager 110. The automatic control can provide many possible energy saving controls.

Typically, the network manager 110 provides timer and zone controls of area that are lit by the multiple lights 130, 132, 134. The timer and zone controls defined the behavior of the lights 130, 132, 134. For example; typically; the lights 130, 132, 134 automatically turn off at night, and lights near windows may be dimmed during the day. Control of the network manager 110 can also be used to override the controlled behavior.

However, it may be desirable to disable (bypass) the automatic control, and provide physical control of one or more of the lights 130, 132, 134. To enable such control, the system of FIG. 1 includes a sensor 160. The sensor 160 is shown in FIG. 1 as a separate unit. However, it is to be understood that the light control and the sensor can be a single unit. The sensor 160 senses physical signaling for determination of whether to operate the system in the automatic mode or the bypass mode. More specifically, if a predetermined sequence within the physical signaling is detected, the mode of the lighting control is set to either the automatic mode or the bypass mode.

For an embodiment, the sensor 160 senses a power supply voltage from, for example, a voltage power supply 150. The voltage sensed by the sensor 160 can be cycled on and off by, for example, by user control of a manual switch 140. The user can signal to the controllers 120, 122, 124 to change the mode of operation of the lights 130, 132, 134 by power cycling the voltage received by the sensor 160. The power cycling can be performed by the user by cycling (turning the manual switch 140 "off" and "on") the settings of the manual switch 140 according to a predetermined, known sequence.

Though the sensor 160 of FIG. 1 senses a voltage, as will be described, the physical signaling can be of many different forms. For example, the sensor 160 can be implemented with light sensor, and the physical signaling can be modulated light. That is, for example, a user could use a light emitting control mechanism (such as, a flash light or a laser pointer) to provide the physical signaling. The user can modulate the light emitting control mechanism according to one or more predetermined sequences. The sensor 160 (as a light sensor) can sense the predetermined sequences that are passed on to the controllers 120, 122, 124 for detection of the sequences. The controllers 120, 122, 124 then switch the operation of the lights 130, 132, 134 to a bypass mode (if the proper sequence is identified), wherein the user has manual control over the lights using the switch 140.

The mode selection (automatic and bypass) can be selected by a single sequence, wherein detection of the single sequence causes the mode to toggle from one mode to the other mode. Alternatively, detection of a first sequence can cause the mode to be automatic, and detection of a second sequence can cause the mode to be bypass. However, as will be shown and described, an embodiment includes the first sequence and the second sequence being non-overlapping or orthogonal to avoid mis-detection between the two modes.

The network manager 110 can be interfaced with an external network during the automatic mode. For an embodiment, the bypass mode includes converting all control of the lights 130, 132, 134 to the network manager 110. That is, the external network loses all control of the lights 130, 132, 134 in the bypass mode, but the external network has control through the network manager 110 in the automatic mode.

Figure 2:
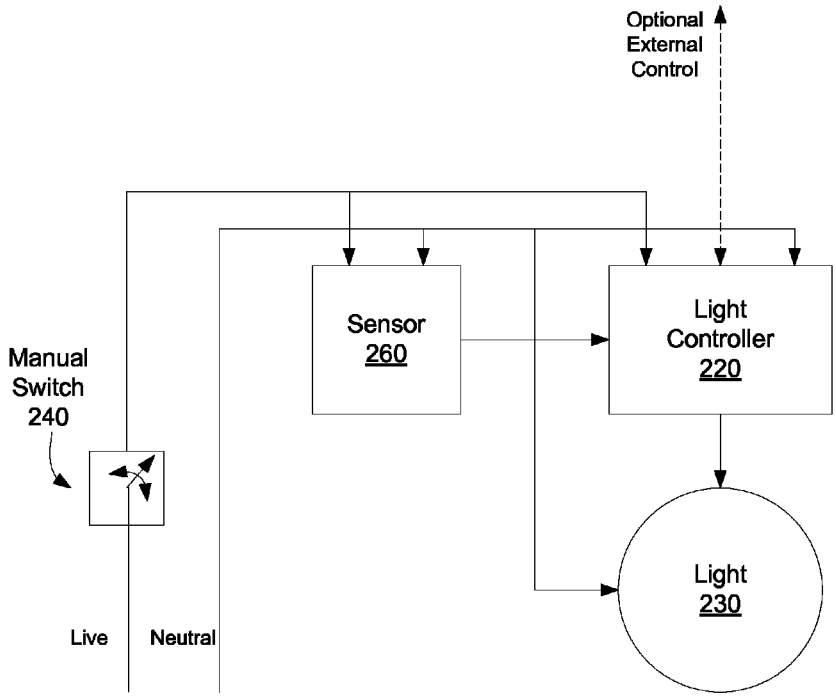
FIG. 2 shows an example of a lighting control apparatus for providing control of a light through an automatic mode or a bypass mode.

FIG. 2 shows an example of a lighting control apparatus for providing control of a light through an automatic mode or a bypass mode. This lighting apparatus includes the light 230, the light controller 220 and the sensor 260. Similar to the embodiment of FIG. 1, the physical signaling in FIG. 2 is provided by a voltage supply (live and neutral power lines). A user can indicate to the lighting control apparatus which mode to operate in by controlling the switch 240 according to the predetermined sequences.

For an embodiment, an external controller controls the light 230 through the light controller 220 in the automatic mode. In the bypass mode, the user has direct control of the light 230 using the switch 240. In another embodiment, the light controller 220 can be bypassed as well.

Figure 3:
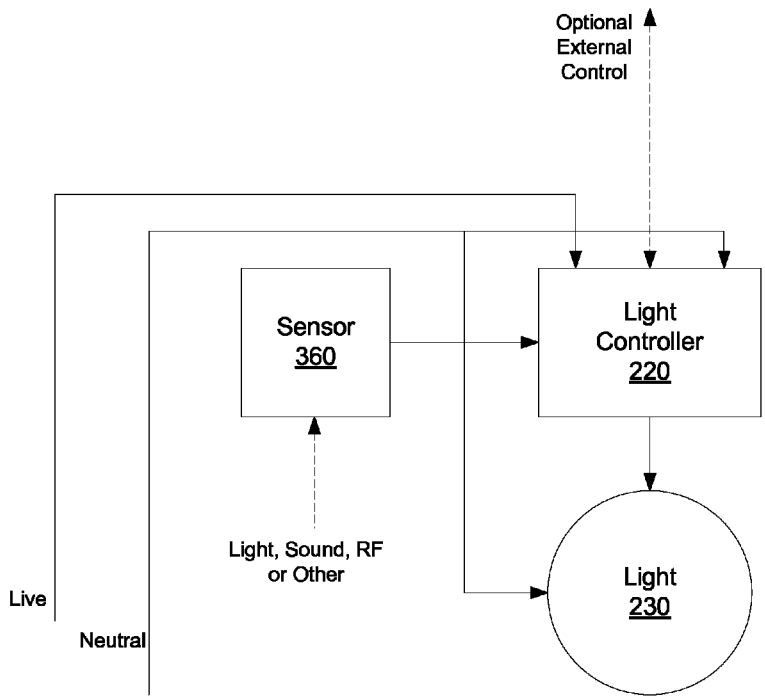
FIG. 3 shows another example of a lighting control apparatus for providing control of a light through an automatic mode or a bypass mode.

FIG. 3 shows another example of a lighting control apparatus for providing control of a light through an automatic mode or a bypass mode. This embodiment is similar to the embodiment of FIG. 2, except that the physical signaling is provided by, for example, a wireless signal, such as, light, sound. It is to be understood that other types of physical signaling could alternatively be utilized. For embodiments, the primary use of the physical signaling is to provide communication to the light controller using wiring or physical environmental sensors rather than a communications device.

A sensor 360 must be able to sense the physical signaling signals. The sequences can then be detected by the light controller for setting the lighting control apparatus into the selected mode.

Figure 4:
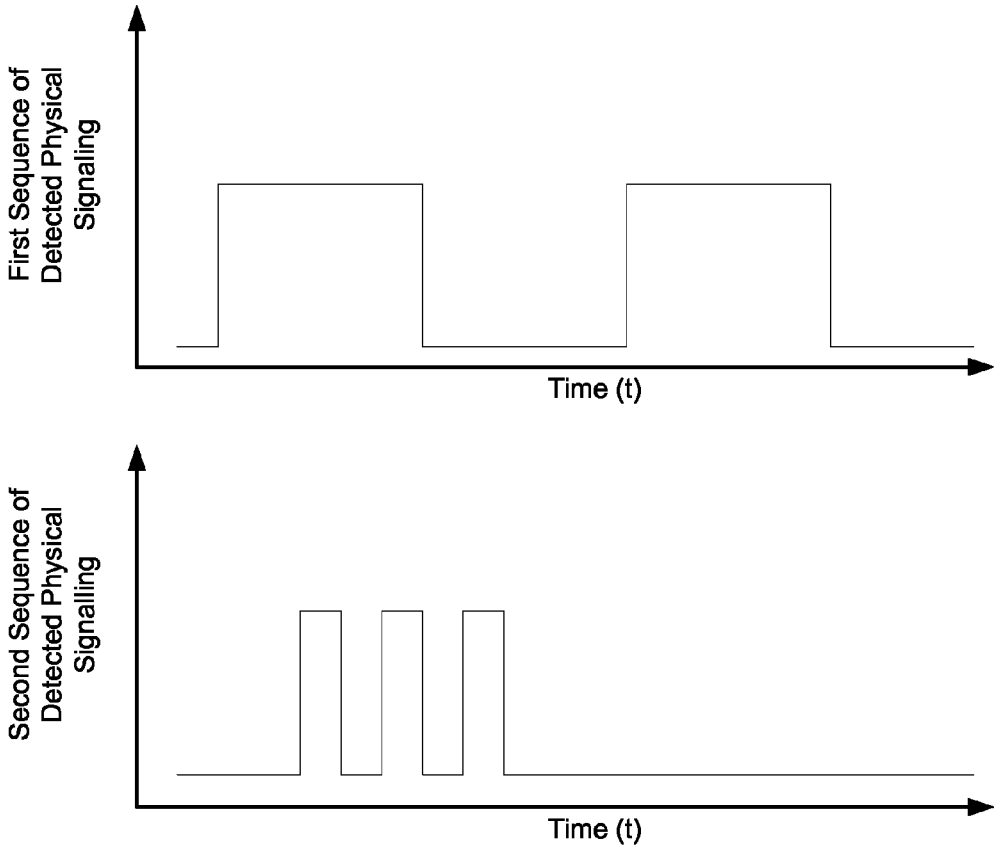
FIG. 4 shows an example of a time line a first sequence and a second sequence of physical signaling for controlling the mode of a light.

FIG. 4 shows an example of a time line a first sequence and a second sequence of physical signaling for controlling the mode of a light. For embodiments, the different sequences are selected to be non-overlapping or orthogonal. Embodiments include the physical signaling being provided by a human (for example, controlling the power switch of a light or lighting system). Therefore, the input sequences of, for example, power cycling of the light is not very precise due to the human control. The orthogonal characteristics of the sequences accommodate for the imprecise human control.

Figure 5:
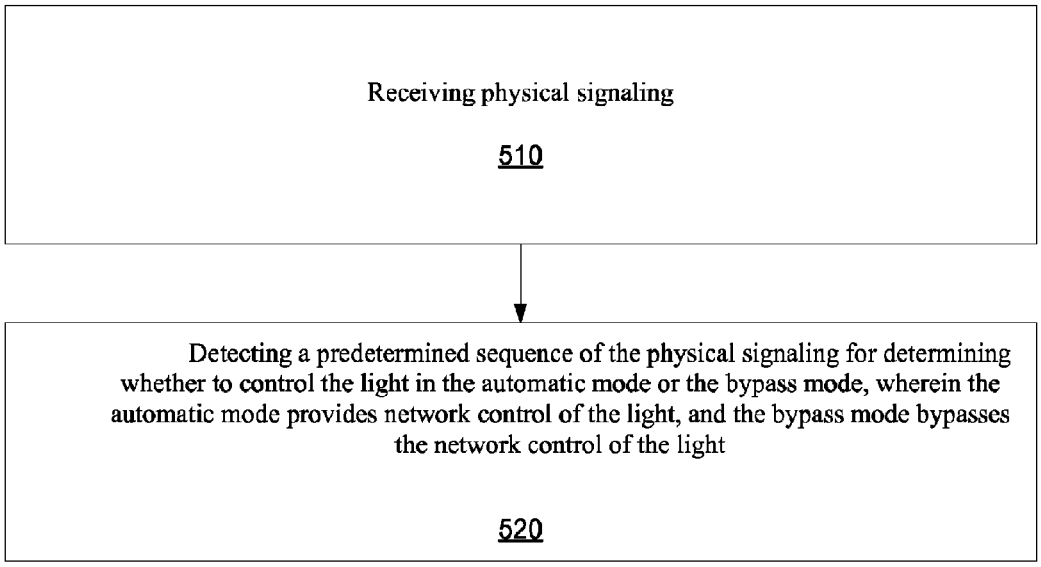
FIG. 5 is a flow chart that includes the steps of an example of a method of providing control of a light through an automatic mode and a bypass mode.

FIG. 5 is a flow chart that includes the steps of an example of a method of providing control of a light through an automatic mode and a bypass mode. A first step 510 includes receiving physical signaling. A second step 520 includes detecting a predetermined sequence of the physical signaling for determining whether to control the light in the automatic mode or the bypass mode, wherein the automatic mode provides network control of the light, and the bypass mode bypasses the network control of the light.

For an embodiment, detection of the predetermined sequence toggles the light from a one of the automatic mode and the bypass mode to the other of the automatic mode and the bypass mode.

An embodiment further includes a first predetermined sequence and a second predetermined sequence, wherein detection of the first predetermined sequence causes the light to be operated in the automatic mode and detection of the second predetermined sequence causes the light to be operated in the bypass mode. As described, for an embodiment, the first predetermined sequence and the second predetermined sequence are non-overlapping. Also as described, for an embodiment, the first predetermined and the second predetermined sequences are orthogonal.

As described, for an embodiment, the physical signaling is provided through a power supply of the light, and the predetermined sequence is detected by detecting power cycling of the power supply. For another embodiment, the physical signaling is provided through a sensor sensing light, and the predetermined sequence is detected by detecting intensity cycling of a source of light. The source of light can be, for example, a flash light is cycled by an operator flashing the light on and off in succession according to one of the predetermined sequences. Clearly, other types of physical signaling can alternatively be utilized, for example, motion, such as, clapping.

An embodiment includes the first predetermine sequence and the second predetermined sequence setting the light in the automatic mode or the bypass mode based upon timing of a plurality of sensed power cycles of the power supply. That is, a timing of power cycling of the power supply according to the first sequence puts the light in the bypass mode and timing of power cycling of the power supply according to the second sequence puts the light in the automatic mode. Further, as will be shown in FIG. 6 and described, an embodiment includes a bypass flag being reset upon powering up the light, and the bypass flag being further set or reset based upon sensing the first sequence or the second sequence. The setting of the bypass flag determines whether the light is in the automatic mode or the bypass mode.

As shown and described, for an embodiment the network is interfaced with an external network in the automatic mode, and the network is disconnected from the external network in the bypass mode. For another embodiment, the light is manually controlled by a user in the bypass mode.

A benefit of the described embodiments is that the bypass mode can act to restore confidence of a user in an intelligent lighting system in case of catastrophic software, communication failure or a cyber-attack/disgruntled employee attack. Historically, lighting in buildings has been robust and is more or less taken for granted. A change in this eco-system is not to be taken lightly. Additionally, the mode selections provided by the described embodiments provide a parachute when all else fails. In most cases, the parachute (bypass mode) brings the user back to where the user was before implementing the intelligent light system.

In at least some embodiments of the light control through an automatic mode and a bypass mode light control, entering the bypass mode does not require the light or the lighting control to be physically manipulated.

Figure 6:
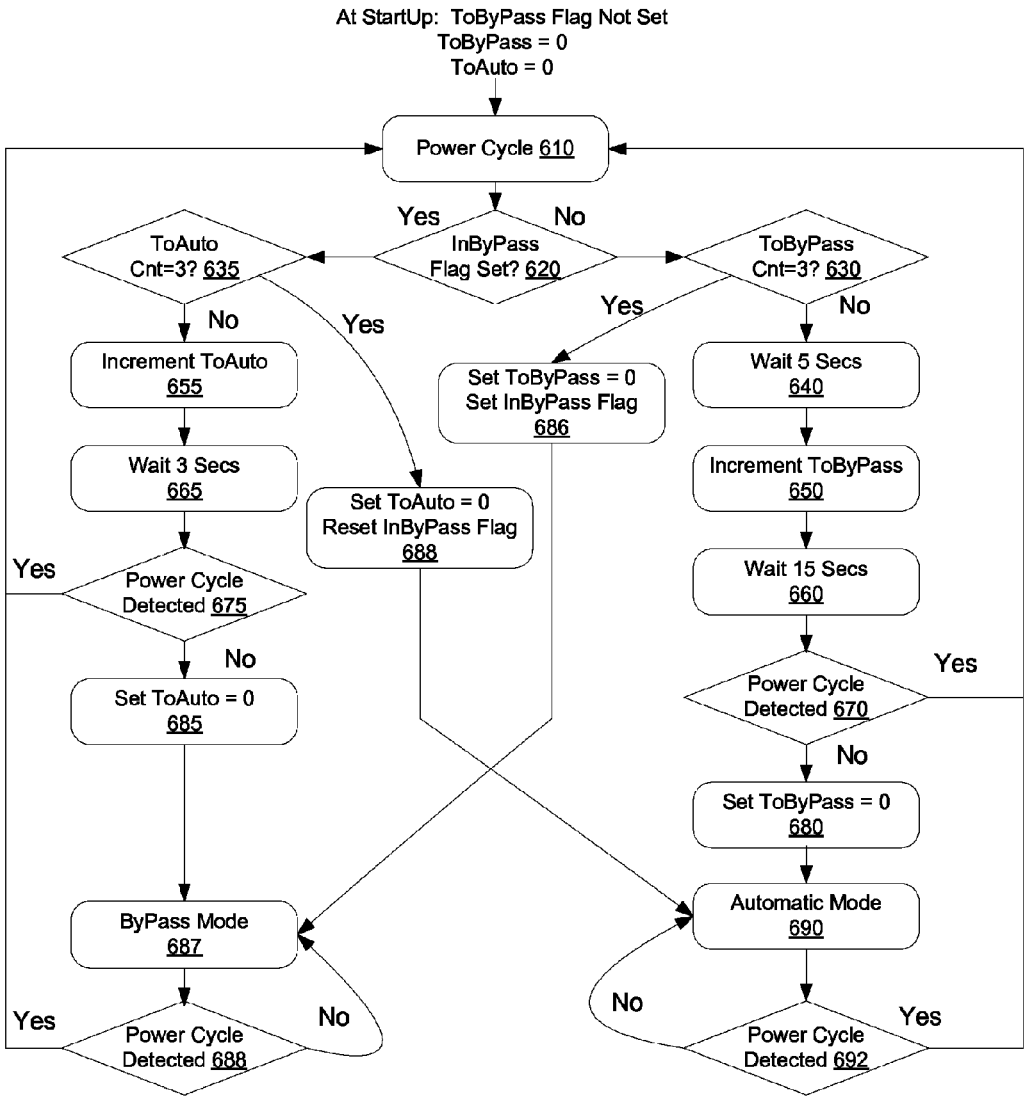
FIG. 6 is a flow chart that includes the steps of an example of a specific method of controlling a light through an automatic mode and a bypass mode.

FIG. 6 is a flow chart that includes the steps of an example of a specific method of controlling a light through an automatic mode and a bypass mode. As previously described, for an embodiment, the physical signaling is provided through a power supply of the light, and the first predetermined sequence and the second predetermined sequence are detected by detecting power cycling of the power supply. Further, setting the light in the automatic mode or the bypass mode is based upon timing of a plurality of sensed power cycles of the power supply, wherein a timing of power cycling of the power supply according to the first sequence puts the light in the bypass mode and timing of power cycling of the power supply according to the second sequence puts the light in the automatic mode. This embodiment is very useful because it can detect the sequences without reliance on a real-time clock.

At startup or power up of the light or lighting system, an embodiment of the lighting controller is reset with a ToByPass flag not being set, a ToByPass counter set to zero and a ToAuto counter set to zero. The ToByPass flag is set or reset (not set) to control whether the lighting system is in bypass or automatic modes. The counters (ToByPass and ToAuto) are used to count power cycling (physical signaling) to determine whether a user is attempting to put the lighting control in bypass or automatic modes. More specifically, the counters count the cycling, and the timing of the cycling is also used for determining detection of the first and second predetermined sequences. As will be described, the bypass (ToByPass) flag is reset upon powering up the light, and the bypass flag is further set or reset based upon sensing (detecting) the first sequence or the second sequence, and the setting of the bypass flag (ToByPass) determines whether the light is to be in the automatic mode or the bypass mode.

At startup, and power cycle 610 is sensed. A step 620 checks if the InByPass flag is not set (as it would not be at startup). If not, a step 630 checks the ToByPass count. If less than 3 (clearly, the count can be adjusted to a different number), a step 640 includes waiting for 5 seconds before incrementing the ToByPass counter (step 650), followed by a step 660 that includes waiting for another 15 seconds. If (step 670) a power cycle is detected within the 15 second wait (of step 660), the power cycle step 610 is repeated. If a power cycle is not detected, then the ToByPass counter is reset to zero (step 680) and the lighting control goes into (actually stays) in the automatic mode (step 690) until another detected power cycle (step 692) takes the process back to step 610.

To leave the automatic mode and go to the bypass mode, the power cycling must occur three time within the 15 second window of step 630. When this occurs, the ToByPass counter is set to zero, and the InByPass flag is set (step 686) is puts the lighting control in the bypass mode (step 687). The next power cycle (step 688) sends the process back to the start (step 610), the InByPass flag is set (step 620) and the ToAuto count is checked to determine if it has reached 3 (step 635). Steps 655, 665, 675 increment (step 655) the ToAuto counter each time a power cycle is detected within 3 seconds (step 665) to determine whether a sequence is detected that then puts the lighting control back into the automatic mode. Otherwise, the ToBypass counter is set to zero (step 685) and the lighting control remains in the bypass mode (step 687). If the ToAuto counter is detected to reach 3 (step 635), the ToAuto counter is reset to zero, and the InByPass flag is reset (step 688), whereby, the lighting control goes back to the automatic mode (690).

Although specific embodiments have been described and illustrated, the described embodiments are not to be limited to the specific forms or arrangements of parts so described and illustrated. The embodiments are limited only by the appended claims.

What is claimed is:

1. A method of controlling a light through an automatic mode and a bypass mode, comprising;

receiving physical signaling;

detecting a first predetermined sequence and a second predetermined sequence of the physical signaling for determining whether to control the light in the automatic mode or the bypass mode, wherein detection of the first predetermined sequence causes the light to be operated in the automatic mode and detection of the second predetermined sequence causes the light to be operated in the bypass mode; wherein the automatic mode provides network control of the light, and the bypass mode bypasses the network control of the light.

2. The method of claim 1, wherein the first predetermined sequence and the second predetermined sequence are non-overlapping.

3. The method of claim 1, wherein the first predetermined sequence and the second predetermined sequence are orthogonal.

4. The method of claim 1, wherein the physical signaling is provided through a power supply of the light, and the first predetermined sequence is detected by detecting power cycling of the power supply.

5. The method of claim 4, further comprising a second predetermined sequence, and further comprising setting the light in the automatic mode or the bypass mode based upon timing of a plurality of sensed power cycles of the power supply, wherein a timing of power cycling of the power supply according to the first sequence puts the light in the bypass mode and timing of power cycling of the power supply according to the second sequence puts the light in the automatic mode.

6. The method of claim 5 wherein a bypass flag is reset upon powering up the light, and the bypass flag is further set or reset based upon sensing the first sequence or the second sequence, and the setting of the bypass flag determines whether the light is in the automatic mode or the bypass mode.

7. A method of controlling a light through an automatic mode and a bypass mode, comprising;

receiving physical signaling, wherein the physical signaling is provided through a sensor sensing light;

detecting a first predetermined sequence of the physical signaling for determining whether to control the light in the automatic mode or the bypass mode, wherein the first predetermined sequence is detected by detecting intensity cycling of a source of light;

the automatic mode provides network control of the light, and the bypass mode bypasses the network control of the light.

8. The method of claim 1, wherein the network is interfaced with an external network in the automatic mode, and the network is disconnected from the external network in the bypass mode.

9. The method of claim 1, wherein the light is manually controlled by a user in the bypass mode.

10. A lighting system, comprising:

a light;

a sensor for receiving and sensing the physical signaling;

a controller detecting a first predetermined sequence and a second predetermined sequence of the physical signaling, wherein detection of the first predetermined sequence causes the light to be operated in an automatic mode and detection of the second predetermined sequence causes the light to be operated in a bypass mode; wherein the automatic mode provides network control of the light, and the bypass mode bypasses the network control of the light.

11. The lighting system of claim 10, wherein the first predetermined sequence and the second predetermined sequence are non-overlapping.

12. The lighting system of claim 10, wherein the first predetermined sequence and the second predetermined sequence are orthogonal.

13. The lighting system of claim 10, wherein the physical signaling is provided through a power supply of the light, and the first predetermined sequence is detected by detecting power cycling of the power supply.

14. The lighting system of claim 10, wherein the physical signaling is provided through a sensor sensing light, and the first predetermined sequence is detected by detecting intensity cycling of light.

15. The lighting system of claim 10, wherein the network is interfaced with an external network in the automatic mode, and the network is disconnected from the external network in the bypass mode.

16. The lighting system of claim 10, wherein the light is manually controlled by a user in the bypass mode.

17. A lighting apparatus, comprising:

a light;

a sensor for receiving and sensing the physical signaling;

a controller detecting a first predetermined sequence and a second predetermined sequence of the physical signaling, wherein detection of the first predetermined sequence causes the light to be operated in an automatic mode and detection of the second predetermined sequence causes the light to be operated in a bypass mode; wherein the automatic mode provides network control of the light, and the bypass mode bypasses the network control of the light.

18. A lighting apparatus, comprising:

a light;

a sensor for receiving and sensing the physical signaling;

a controller operative to detect a first predetermined sequence of the physical signaling, for determining whether to control the light in an automatic mode or a bypass mode, wherein detection of the first predetermined sequence toggles the light from a one of the automatic mode and the bypass mode to the other of the automatic mode and the bypass mode, wherein detection of the first predetermined sequence includes a counter counting a preset number of cycles of the physical signaling within a predetermined period of time, without use of a real time clock;

the automatic mode provides network control of the light, and the bypass mode bypasses the network control of the light.

* * * * *